US006293041B2

(12) United States Patent
Weaver

(10) Patent No.: US 6,293,041 B2
(45) **Date of Patent: *Sep. 25, 2001**

(54) RIFLE REST

(75) Inventor: Michael S. Weaver, P.O. Box 529, Arlee, MT (US)

(73) Assignees: Marty Lytle; Michael S. Weaver, both of Arlee, MT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/177,752

(22) Filed: Oct. 23, 1998

(51) Int. Cl.[7] ..... F41A 27/00
(52) U.S. Cl. ..... 42/94; 89/37.04
(58) Field of Search ..... 42/94; 89/37.04, 89/37.03, 37.02, 37.12

(56) References Cited

U.S. PATENT DOCUMENTS

| | | | | |
|---|---|---|---|---|
| 282,551 | * | 8/1883 | McLean | 89/37.01 |
| 1,324,934 | * | 12/1919 | Shand | 42/94 |
| 1,974,459 | * | 9/1934 | Haubroe | 89/37.01 |
| 2,200,283 | * | 5/1940 | Lennon | 89/37.03 |
| 2,427,365 | * | 9/1947 | Meister | 89/37.04 |
| 3,358,504 | * | 12/1967 | Freebairn | 89/37.04 |
| 3,428,305 | | 2/1969 | Bohn | 269/75 |
| 3,815,892 | | 6/1974 | Tulk | 269/75 |
| 3,947,988 | * | 4/1976 | Besaw | 42/94 |
| 4,055,017 | * | 10/1977 | Thompson | 42/94 |
| 4,333,385 | * | 6/1982 | Culver | 89/37.04 |
| 4,352,486 | | 10/1982 | Wagster | 269/75 |
| 5,058,302 | * | 10/1991 | Minneman | 42/94 |
| 5,067,268 | | 11/1991 | Ransom | 42/94 |
| 5,194,678 | | 3/1993 | Kramer | 42/94 |
| 5,402,595 | | 4/1995 | Tamllos | 42/94 |
| 5,703,317 | * | 12/1997 | Levilly et al. | 42/94 |
| 5,887,374 | * | 3/1999 | Brass | 42/94 |

FOREIGN PATENT DOCUMENTS

| | | | | |
|---|---|---|---|---|
| 211677 | * | 1/1941 | (CH) | 89/37.03 |
| 700981 | * | 1/1941 | (CA) | 89/37.03 |
| 527397 | * | 12/1914 | (FR) | 89/37 B |
| 420638 | * | 2/1934 | (IT) | 89/37 B |
| 419505 | * | 1/1941 | (IT) | 89/37 B |

* cited by examiner

*Primary Examiner*—Charles T. Jordan
*Assistant Examiner*—Denise J Buckley
(74) *Attorney, Agent, or Firm*—Saliwanchik, Lloyd & Saliwanchik, P.C.

(57) ABSTRACT

The present invention involves a rifle rest which is particularly suited for competitive long distance range shooting. The rifle rest has a rifle vise mounted on a vise support resting upon a base which has adjustable legs. In a preferred embodiment, the rifle vise is mounted on a vise support which is a sphere or partial sphere. The convex curvature of the sphere is slidably received by an aperture in a planar base allowing for the movement and rotation of a rifle secured in the vise about a variety of axes.

11 Claims, 4 Drawing Sheets

RIFLE REST

BACKGROUND OF THE INVENTION

In competitive long distance range shooting a competitor is given 8 minutes in which to fire ten rounds at a target placed at 1000 yards. The size of the group created by the ten shots as they pass through the target determines the competitor's score. The tighter the group, the higher the score. Currently, the 1000 yard world record is a group often shots in an area 6 13/16 inches in diameter. Rifles used in long range shooting competitions are generally of a larger caliber and heavy. Larger caliber bullets have higher sectional densities and greater ballistic coefficients which allow them to fly in a relatively flatter trajectory along the 1000 yard distance compared to smaller caliber bullets. Heavy barrels have smaller harmonics causing less barrel displacement after firing and therefore providing greater accuracy. Heavy rifles also absorb the recoil generated when firing the larger calibers and add stability to the rifle. Recoil can displace a rifle aimed at a target. Heavy rifles are not displaced from position as greatly as lighter rifles upon firing. A stable, heavy rifle is therefore easier to reposition and aim for subsequent shots which in competition must be taken in rapid succession.

Rifles used in competitive long distance range shooting are generally supported by rifle rests. The most commonly used rests are tripod stands supporting a sand bag or vise to hold the rifle. The legs of the tripod have mechanical adjustments to position and aim the rifle (U.S. Pat. No. 5,067,268). These mechanical adjustments comprise a multitude of knobs and levers. The process of initially aligning the rifle with the target can be tedious and time consuming. After each shot the user must repeat this tedious, time consuming process to realign the rifle with the target for the next shot. The time constraints of competition make using these rests detrimental to the accuracy and score of the competitor.

A rifle placed upon a rifle rest may have to adjusted by tilting, rocking or rotating the rifle to aim it at the target. Some rests provide a full range of adjustment (U.S. Pat. Nos. 5,194,678 and 5,402,595). It is an advantage however that these adjustments be made independently of one another. For example, a vertical adjustment should not affect the horizontal position therefore causing further adjustments and additional time. Certain vises provide such adjustability (U.S. Pat. Nos. 3,428,305, 3,815,892 and 4,352,489) but do not provide the stability and mass required to adequately support a rifle for firing.

A rifle rest that quickly and easily aligns the rifle with the target without losing accuracy would provide a competitor an advantage in the sport of long distance range shooting. Additionally, a competitive advantage would be assumed from a rifle rest that is stable and able to withstand the recoil of large caliber rifles. There remains a need for such a rifle rest.

BRIEF SUMMARY OF THE INVENTION

The present invention involves a rifle rest which is particularly suited for long distance range shooting. The subject rifle rest comprises a rifle vise mounted on a vise support which rests upon a base having adjustable legs. In a preferred embodiment, the vise support is a sphere or partial sphere. The convex curvature of the vise support is received by an aperture in a planar base allowing for sliding engagement therebetween and providing adjustment between the vise support and planar base. A rifle mounted on the rifle vise can be quickly and easily aimed at a target by slidably adjusting the position between the vise support and planar base. The rifle rest of the subject invention allows adjustments for aim to be made about a number of axes at a multitude of altitudes.

DETAILED DISCLOSURE OF THE INVENTION

Figure 1:
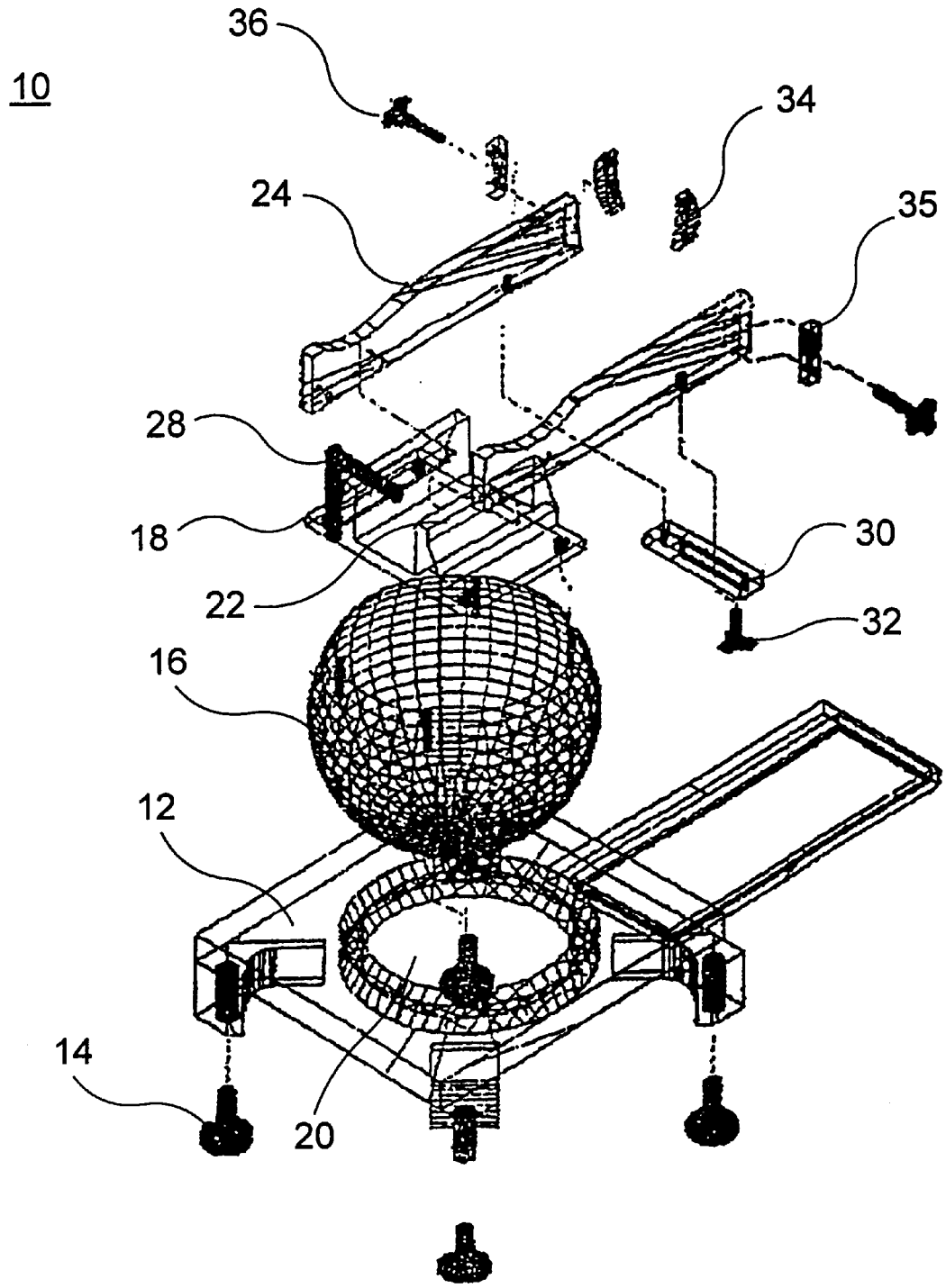
FIG. 1 shows an exploded view of the rifle rest of the present invention.
Figure 2:
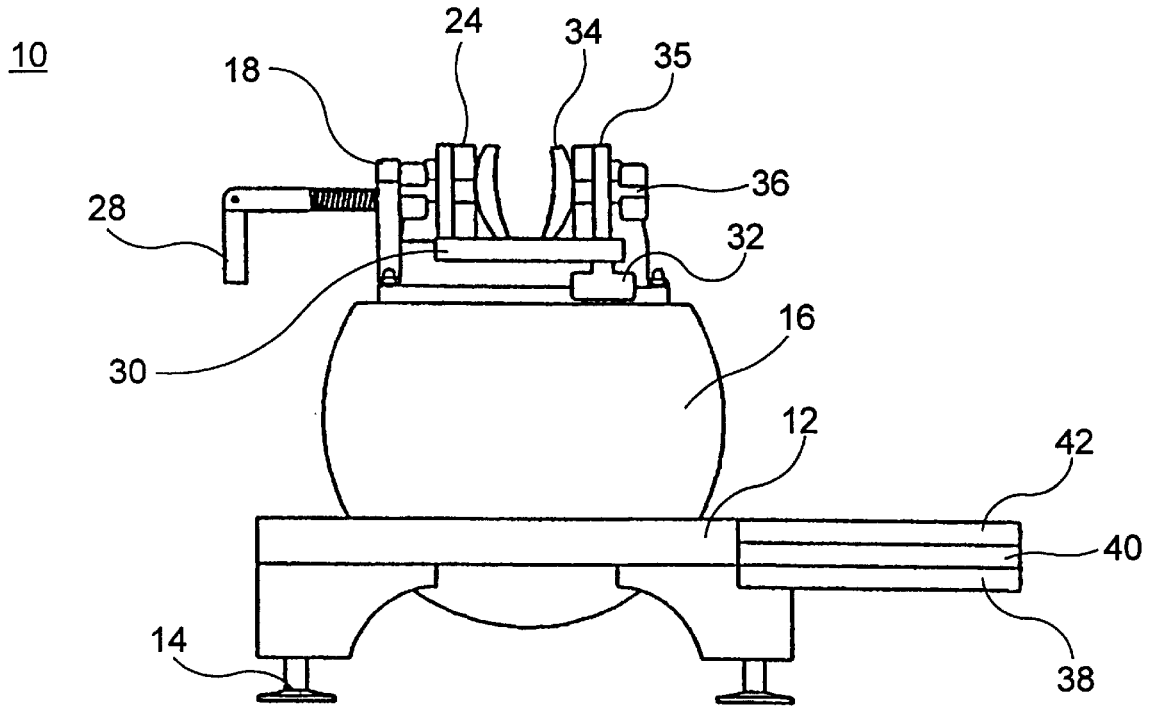
FIG. 2 shows a front elevational view of the rifle rest of the present invention.
Figure 3:
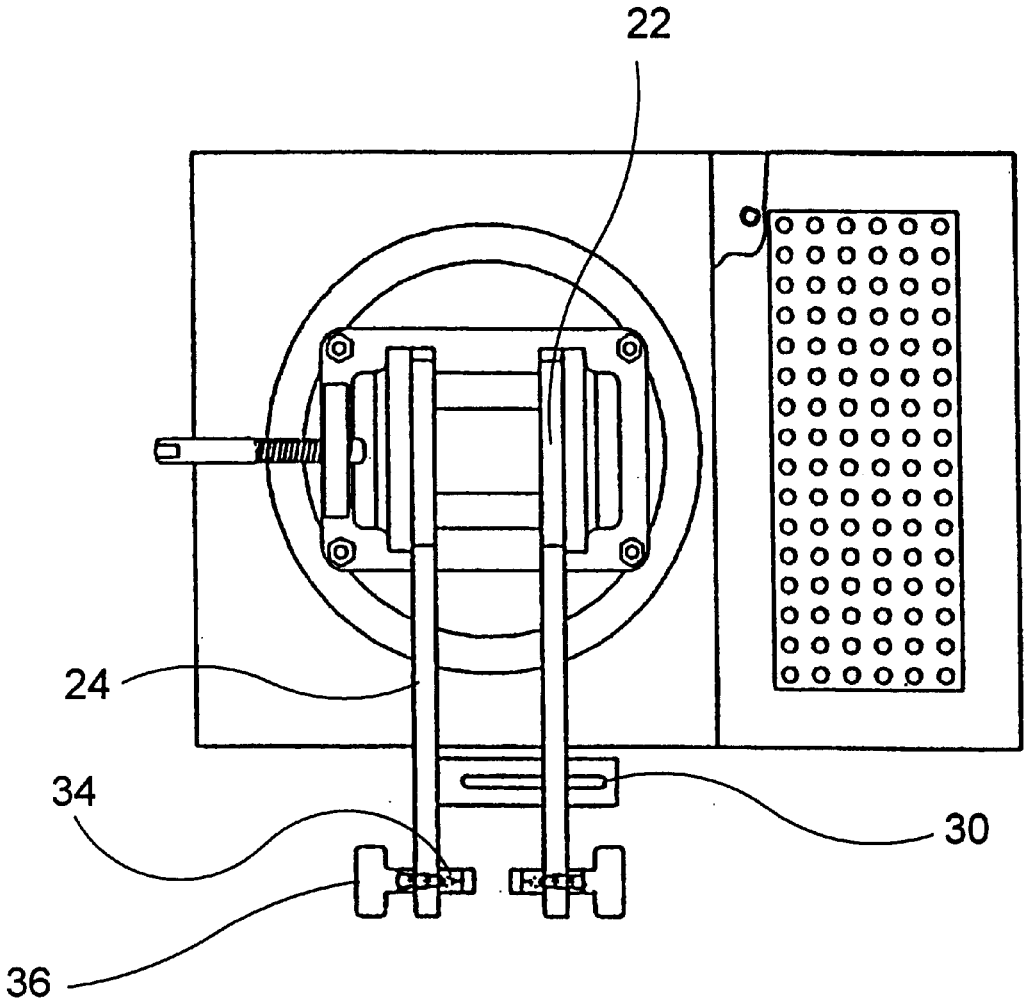
FIG. 3 shows a top view of the rifle rest of the present invention.
Figure 4:
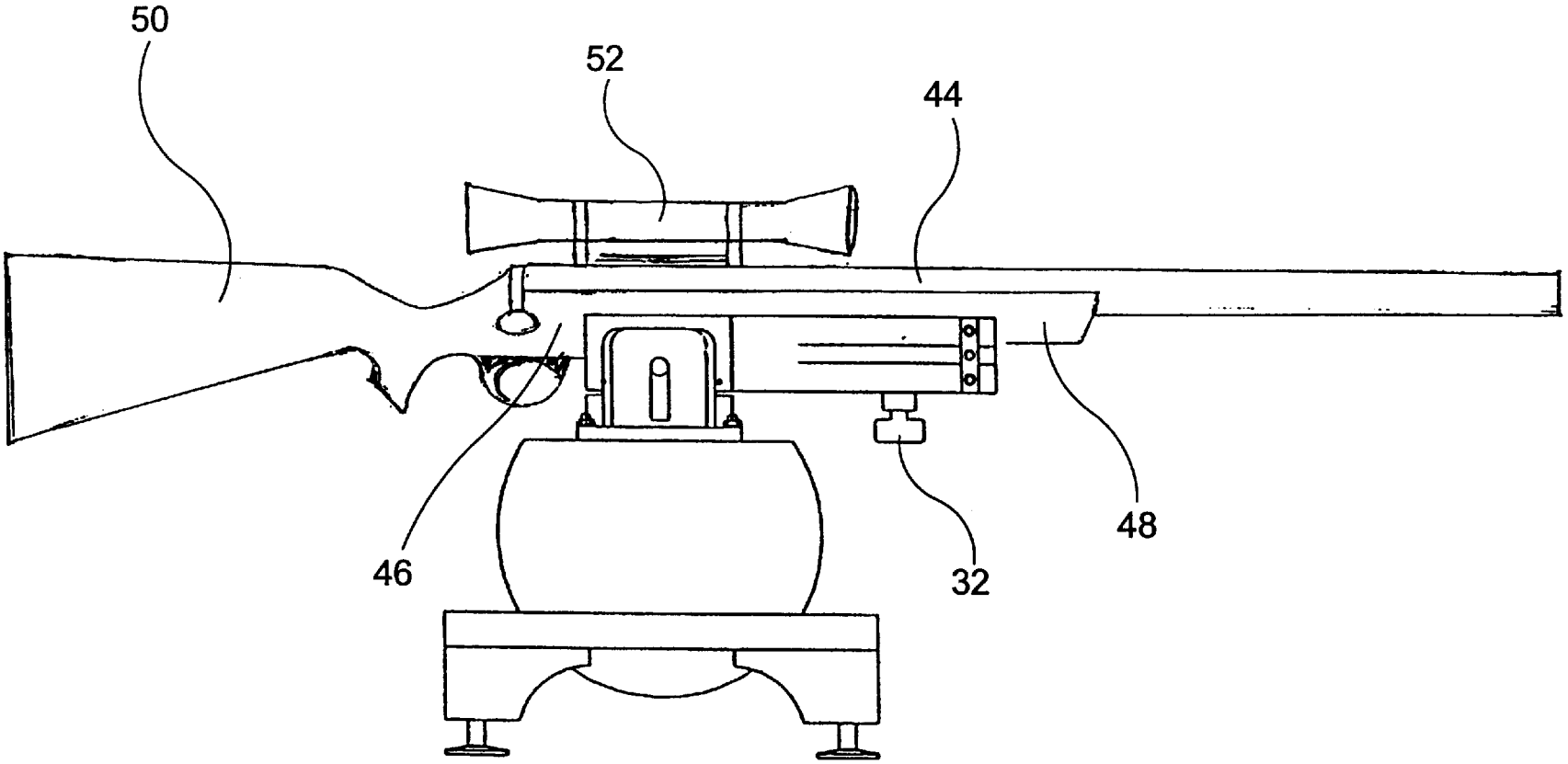
FIG. 4 shows a side elevational view of a rifle mounted in the rifle rest of the present invention.

The present invention involves a rifle rest that is particularly suited for competitive long distance range shooting. The rifle rest comprises a rifle vise mounted upon a vise support which rests on a base which has adjustable legs. The rifle rest of the subject invention allows a shooter to quickly and easily align the rifle to the target without sacrificing accuracy. A preferred embodiment of the rifle rest is shown generally at 10 in FIGS. 1 and 2. The subject rifle rest comprises a planar base 12 having four adjustable legs 14, a vise support 16 and a rifle vise 18. In the exemplified embodiment, the vise support 16 is a sphere or partial sphere. The convex curvature of the sphere rests in an aperture 20 in the base 12 wherein the vise support 16 and base are slidably engaged allowing for rotation and orientation of a rifle held in the vise 18 about a number of axes.

The base 12 of the rifle rest of the subject invention has a top or upper surface and an undersurface, and can be any shape. Adjustable legs 14 are on the undersurface of the base. In the exemplified embodiment, the base is planar and has four adjustable legs placed as opposing pairs to provide ultimate stability. The base may have any number of adjustable legs which provide a steady platform from which to shoot. In a preferred embodiment, the planar base 12 is approximately 12 inches by 12 inches square and one inch thick. The adjustable legs 14 are placed at each comer of the square and have foot pads about one inch in diameter for stability. The adjustable legs can be moveable by a number of conventional means including locking springs, pistons and screw action. The adjustable legs allow the base to be leveled on the uneven surfaces of shooting benches or on benches that are not properly leveled to the ground. The base can be made of a number of materials. Plastics are advantageous because they are inexpensive and durable. Low density plastics are useful in making the bases according to the subject invention however high density plastics are preferred. High density plastics are heavier and have a higher tensile strength.

A vise support 16 rests upon the base 12. In a preferred embodiment, the vise support 16 is spherical and the convex curvature of the sphere rests in a circular aperture 20 in a planar base 12 (see FIG. 1). The base 12 and the support 16 are slidably engaged allowing for movement and rotation of the sphere within the aperture. It is preferred that the aperture 20 tapers slightly from the upper surface of the base 12 to the undersurface of the base to which the legs are attached. For example, an aperture cut to receive a nine inch diameter sphere in a one inch thick base can have an opening on the upper surface which measures approximately 7 15/16 inches and tapers to an opening of about 6¾ inches on the undersurface of the base. Tapering the aperture 20 provides the sphere added stability when rotated. In a particularly preferred embodiment, the tapered surface of the aperture is lined with a material that reduces the friction between the two surfaces and allows the sphere to move smoothly. Materials useful in lining the aperture include beaver felt, leather chamois, nylon strapping, foam rubber and fiberglass stove gasket, with fiberglass stove gasket being preferred.

The vise support should be made of materials of suitable strength to withstand the recoil and impact of rifle fire. Preferably, the material used to construct the vise support of the subject invention can absorb some of the recoil produced. Further, the support should be of sufficient weight to provide a stable base for the vise. It has been discovered that a bowling ball provides many of these desirable properties. Bowling balls are made of resilient high-density plastic which will not shatter upon impact. Additionally, bowling balls are weighted providing a stable support. In a preferred embodiment, a fourteen pound ball is used as a vise support in the subject rifle rest. Bowling balls are also amenable to being bored so that additional slugs of lead weights can be inserted into the support offering the ability to add or subtract weight and tailor the rest to the shooter and the rifle.

The rifle vise 18 is mounted on the vise support 16. When the vise support is spherical, the rifle vise can be mounted at any of its surface. In the exemplified embodiment, however, the rifle vise 18 is mounted on a planar surface on the sphere created by cutting the sphere transversely. The rifle vise 18 can be any standard-type vise. A typical vise has at least one pair of opposing jaws that are moved slidably toward and away from one another by screw action. Generally, a handle is attached to the screw to operate the vise. The jaws of the vise can be lined or cushioned to prevent damaging the stock and to absorb recoil. Suitable materials to cushion the stock include various foam and batting materials. Lead-padded foam has been found to be particularly useful for lining the jaws of the rifle vise. The lead-padded foam is durable, offers weight and stability to the rest and provides some insulating properties from the noise produced upon firing the rifle.

In a preferred embodiment, the rifle vise 18 comprises specialized jaws for holding a rifle. The vise can comprise two pairs of jaws, the first holds the rifle 44 at the stock under the action 46, the second grips the forearm 48 of the stock. The jaws can be manipulated and configured in a variety of ways. In the exemplified embodiment, stock jaws 22 are tightened around the stock of the rifle beneath the action by a screw operated by a handle 28. Extended spring jaws 24 are adjusted to conform to the forearm of the stock using a sliding lock block 30 which is set by a sliding lock block knob 32. A pair of clamps 34, set blocks 35 and set knobs 36 on the distal ends of the spring jaws 24 secure the stock in the vise.

The base 12 can be modified to include bullet trays to provide ready access to ammunition for a competitive shooter. Bullet trays rest upon a mounting plate 38 which is attached to the underside of the base 12 or can be integrally formed therefrom. In a preferred embodiment, the rifle rest of the subject invention is provided with several trays which are able to hold a variety of shell casing sizes. For example, the rifle rest 10 shown in FIG. 2 has a bullet tray 40 to hold shells with bullets ranging in caliber from 7 mm magnum to 0.358. A second bullet tray 42 is provided to hold shells with bullets ranging in caliber from 0.243 to 0.30—'06. Bullet trays can be configured to hold any number of shells, optimally, the bullet tray should hold at least the 10 shells necessary to complete one round of competition and preferably enough to complete two rounds.

In use, the rifle rest of the subject invention provides a shooter a stable, rapidly adjustable stand from which to shoot. In the exemplified embodiment, the rifle is placed in the rest by positioning the stock beneath the action 46 of the rifle in the stock jaws 22 and tightening the jaws with the handle 28. The forearm 48 of the stock lying between the spring jaws 24 of the rifle vise 18 is secured by adjusting the sliding lock block 30 and tightening the sliding lock block knob 32. The forearm of the stock 48 is locked into the vise by adjusting the clamps 34 using the set knobs 36. With the rifle secured in the rest, the rifle is loaded and the shooter takes position behind the butt 50 of the stock and peers through the telescopic sight 52 to aim the rifle at the target. The rifle is readily aimed at the target by rocking, tilting and rotating the rifle into position as the vise support 16 moves slidably within the aperture 20 of the base 12. It should be noted, the rifle is not aimed by positioning the adjustable legs 14 of the base 12. The adjustable legs are only to level the rest upon an uneven shooting surface. The rifle is aimed at the target by moving the rifle and vise support upon the base. The vise support is not locked down or secured to the base before shooting. After the rifle is properly aimed, the rifle is fired. The recoil from firing the rifle may slightly displace the aim for subsequent shots. Displacement is minimized however since the mass of the vise support reduces the effect of the recoil. The vise support should reduce recoil by at least 25% and preferably by 50% or more. The rifle rest in FIG. 1 reduces the effect of recoil by as much as 60%. Further, aim can be rapidly restored since the subject rest is not locked and does not rely upon knobs or levers for adjustment. The rifle rest of the subject invention provides a stable shooting platform and enables the user to quickly and easily align a rifle with a target without sacrificing accuracy for precise long distance range shooting.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A rifle rest, in combination, having: a planar base; a spherical or partially spherical, solid, weighted support slidably engaged in an aperture in said base; and a rifle vise comprising at least two pair of jaws to secure the stock of a rifle to said rifle rest, wherein said solid, weighted vise support has sufficient mass to hold a rifle in position and wherein said solid, weighted vise support absorbs the recoil generated by a rifle shot.

2. The rifle rest of claim 1, wherein said base is planar.

3. The rifle rest of claim 1, when said rifle vise comprises a first pair of jaws to secure the stock of a rifle under the action to said rifle rest and a second pair of jaws to secure the forearm of the stock of a rifle to said rifle rest.

4. The rifle rest of claim 1, further comprising one or more bullet trays mounted to said base.

5. The rifle rest of claim 1, wherein said vise support weighs about 18 pounds.

6. The rifle rest of claim 1, wherein said vise support weighs about 14 pounds.

7. The rifle rest of claim 1, wherein said vise support is a bowling ball.

8. The rifle rest of claim 1, wherein said vise support is a bowling ball weighing 14 pounds.

9. The rifle vise of claim 1, where said vise support weighs at least about six pounds.

10. The rifle vise of claim 1, wherein said base has adjustable legs.

11. The rifle rest of claim 10, wherein said base has at least four adjustable legs.

* * * * *

UNITED STATES PATENT AND TRADEMARK OFFICE

CERTIFICATE OF CORRECTION

PATENT NO. : 6,293,041 B2
DATED : September 25, 2001
INVENTOR(S) : Weaver

It is certified that error appears in the above-identified patent and that said Letters Patent is hereby corrected as shown below:

Column 6,
Lines 1 and 2, should read -- wherein said vise support weighs from about eight to about 18 pounds. --

Signed and Sealed this

Ninth Day of July, 2002

*Attest:*

*Attesting Officer*

JAMES E. ROGAN
*Director of the United States Patent and Trademark Office*